US009011151B1

(12) United States Patent
Jones et al.

(10) Patent No.: US 9,011,151 B1
(45) Date of Patent: Apr. 21, 2015

(54) SYSTEM AND METHOD FOR SIMULATING FIRING A GUN

(75) Inventors: Giles D. Jones, Chino Hills, CA (US); Qingce Bian, Corona, CA (US); Christopher A. Tomlinson, Vail, AZ (US); Jeffrey E. Decker, Moreno Valley, CA (US); William W. Price, Upland, CA (US); Bradley C Huang, Chino Hills, CA (US); Peter M. Wallrich, Upland, CA (US)

(73) Assignee: Raytheon Company, Waltham, MA (US)

( * ) Notice: Subject to any disclaimer, the term of this patent is extended or adjusted under 35 U.S.C. 154(b) by 1146 days.

(21) Appl. No.: 11/562,456

(22) Filed: Nov. 22, 2006

(51) Int. Cl.

| | |
|---|---|
| ***F41A 33/00*** | (2006.01) |
| ***F41A 33/02*** | (2006.01) |
| *F41J 5/02* | (2006.01) |
| *F41A 21/26* | (2006.01) |
| *F41A 19/58* | (2006.01) |
| *F41A 33/06* | (2006.01) |
| *F41G 3/26* | (2006.01) |
| *F41G 1/54* | (2006.01) |
| *F41C 23/06* | (2006.01) |

(52) U.S. Cl.
CPC .. *F41A 33/02* (2013.01); *F41J 5/02* (2013.01); *F41A 33/00* (2013.01); *F41A 21/26* (2013.01); *F41A 19/58* (2013.01); *F41A 33/06* (2013.01); *F41G 3/2633* (2013.01); *F41G 1/54* (2013.01); *F41G 3/2683* (2013.01); *F41C 23/06* (2013.01); *F41G 3/2655* (2013.01)

(58) Field of Classification Search
CPC ..... F41A 33/02; F41A 21/26; F41A 33/00; F41A 33/06; F41A 19/58; F41G 3/2655; F41G 3/2633; F41G 3/2683; F41G 1/54; F41J 5/02; F41C 23/06
USPC ..... 434/11, 16–24; 42/84; 463/49, 51
See application file for complete search history.

(56) References Cited

U.S. PATENT DOCUMENTS

| | | | | |
|---|---|---|---|---|
| 3,938,262 | A | 2/1976 | Dye et al. | |
| 4,804,325 | A * | 2/1989 | Willits et al. | 434/22 |
| 4,823,401 | A * | 4/1989 | Gammarino et al. | 398/128 |
| 5,761,954 | A * | 6/1998 | Dvorak | 73/167 |

(Continued)

FOREIGN PATENT DOCUMENTS

| | | |
|---|---|---|
| DE | 26 25 931 A1 | 12/1977 |
| EP | 0 401 731 A1 | 12/1990 |

(Continued)

OTHER PUBLICATIONS

"*I-10. Location and Description of Major Components*", Army TM 9-1005-317-23&P, Navy SW 370-AA-MM0-010/9mm, Air Force to 11W3-3-5-4, Marine Corps TM 1005-23&P/2, Coast Guard Comdtinst M8370.7, p. 1-3, Jun. 2006.

(Continued)

*Primary Examiner* — Jack Yip

(57) ABSTRACT

According to one embodiment of the present invention, a system for simulating firing a gun comprises a firing system and a transmitting system coupled to the firing system. The firing system fires a cartridge and comprises a chamber and a hammer. The chamber receives and holds the cartridge, and the hammer strikes the cartridge. The transmitting system detects movement of the hammer and transmits simulation data prior to the hammer striking the cartridge.

21 Claims, 2 Drawing Sheets

(56) References Cited

U.S. PATENT DOCUMENTS

| | | | | |
|---|---|---|---|---|
| 5,947,738 | A * | 9/1999 | Muehle et al. | 434/16 |
| 7,329,127 | B2 * | 2/2008 | Kendir et al. | 434/21 |

FOREIGN PATENT DOCUMENTS

| | | | |
|---|---|---|---|
| EP | 1 308 689 | A2 | 7/2003 |
| WO | WO 2005/061983 | A1 | 7/2005 |

OTHER PUBLICATIONS

"*Multiple Integrated Laser Engagement System (MILES)*", GlobalSecurity.org, http://www.globalsecurity.org/military/systems/ground/miles.htm, 2 pages, Printed Jun. 21, 2006.

"*Semi-automatic self-loading pistol*", Wikipedia, the free encyclopedia, http://en.wikipedia.org/wiki/Semi-automatic_pistol, 8 pages, Printed Jul. 12, 2006.

Pending U.S. Appl. No. 12/024,693 entitled "Simulated Firearm Having a Multiple Integrated Laser Engagement System", 17 pages spec, claims, and abstract, 5 pages of drawings, inventors Giles D. Jones et al., Feb. 1, 2008.

PCT Notification of Transmittal of the International Search Report and the Written Opinion of the International Searching Authority, or the Declaration with attached PCT International Search Report and Written Opinion of the International Searching Authority in International Application No. PCT/US2008/052800, dated Nov. 17, 2008, 14 pages.

European Patent Office, Communication pursuant to Article 94(3) EPC, Application No. 08 799 611.2-1260, 5 pages, Dec. 7, 2009.

Office Action for pending U.S. Appl. No. 12/024,693 entitled "Simulated Firearm Having a Multiple Integrated Laser Engagement System", 9 pages, Apr. 14, 2011.

* cited by examiner

SYSTEM AND METHOD FOR SIMULATING FIRING A GUN

GOVERNMENT FUNDING

The U.S. Government may have certain rights in this invention as provided for by the terms of Grant No. N61339-00-D-0001 awarded by the Program Executive Office for Simulation, Training, & Instrumentation (PEOSTRI) of the U.S. Army.

TECHNICAL FIELD OF THE INVENTION

This invention relates generally to the field of firearms and more specifically to a system and method for simulating firing a gun.

BACKGROUND OF THE INVENTION

Soldiers involved in training exercises simulate a realistic battlefield environment by using Multiple Integrated Laser Engagement System (MILES) training systems. These systems simulate the firing of weapons using lasers.

Known MILES techniques may use a laser transmitting system that simulates the firing of a weapon. Other known MILES techniques may include a laser transmitting clamp that attaches to the barrel of an actual gun loaded with blank bullet cartridges. These known MILES techniques cannot accurately simulate certain types of guns.

SUMMARY OF THE INVENTION

In accordance with the present invention, disadvantages and problems associated with previous techniques for simulating firing a gun may be reduced or eliminated.

According to one embodiment of the present invention, a system for simulating firing a gun comprises a firing system and a transmitting system coupled to the firing system. The firing system fires a cartridge and comprises a chamber and a hammer. The chamber receives and holds the cartridge, and the hammer strikes the cartridge. The transmitting system detects movement of the hammer and transmits simulation data prior to the hammer striking the cartridge.

Certain embodiments of the invention may provide one or more technical advantages. A technical advantage of one embodiment may be that simulation data is transmitted before the hammer strikes the cartridge. This causes the simulation data to be transmitted accurately, but still allows for a realistic simulation of the recoil associated with firing a gun. As a result, the firing of a handgun may be accurately simulated.

A technical advantage of a further embodiment may be that the trigger sensor detects movement of the sear. This allows the transmitting system to transmit simulation data prior to the hammer striking the cartridge.

A technical advantage of a further embodiment may be that the shock sensor allows the transmitting system to transmit simulation data after it detects either the movement of the slide assembly or the recoil simulated by the firing system. As a result, simulation data my be transmitted without firing a cartridge, allowing the transmitting system to be tested.

Certain embodiments of the invention may include none, some, or all of the above technical advantages. One or more technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE INVENTION

Embodiments of the present invention and its advantages are best understood by referring to FIGS. 1 through 5 of the drawings, like numerals being used for like and corresponding parts of the various drawings.

Figure 1:
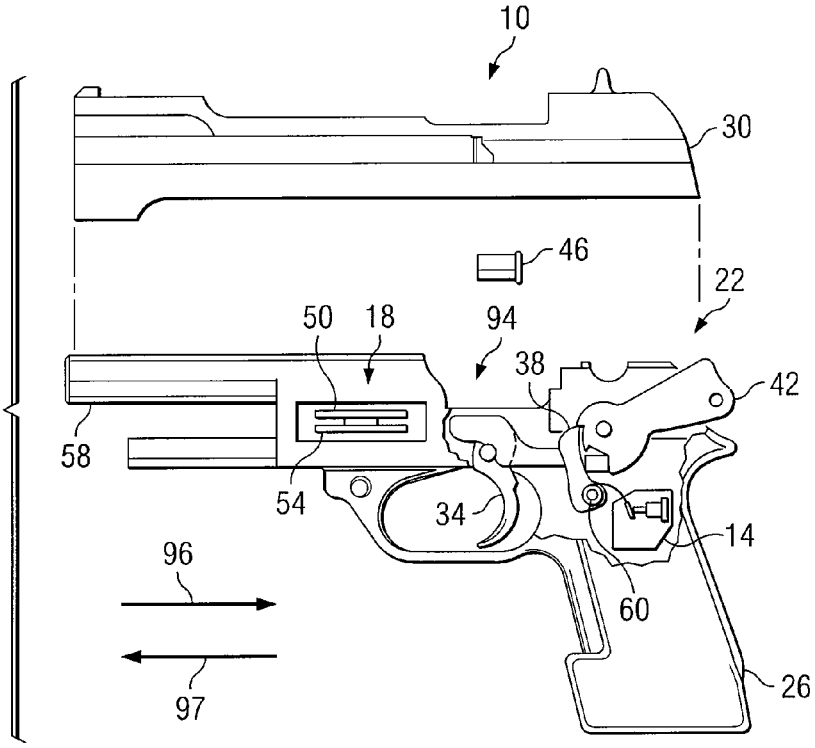
FIG. 1 is a side view diagram of one embodiment of a system operable to simulate firing a gun.

FIG. 1 is a side view diagram of one embodiment of a system 10 operable to simulate firing a gun. According to the embodiment, system 10 comprises a firing system 22 and a transmitting system 18. Firing system 22 holds a cartridge and strikes the cartridge with a hammer to fire the cartridge. Firing system 22 may also simulate the recoil associated with firing a cartridge from a gun. Transmitting system 18 detects movement of the hammer and transmits simulation data prior to the hammer striking the cartridge. The simulation data may simulate the pathways associated with a bullet fired from a gun. Transmitting the simulation data prior to the hammer striking the cartridge may allow system 10 to accurately simulate the firing of a handgun.

System 10 may be used to simulate the firing of any suitable gun. A gun may refer to a mechanical device that fires projectiles, and may have any suitable length, weight, range of accuracy, and magazine capacity. Examples of guns may include a machine gun, a sniper rifle, a submachine gun, or a handgun. In the illustrated embodiment, system 10 simulates the firing of any suitable handgun. A handgun may have a length between 100 and 300 millimeters, a weight between 500 and 1,000 grams, a range of accuracy between 20 and 75 meters, and a magazine capacity between 5 and 20 cartridges. According to the illustrated embodiment, the handgun has a length of approximately 217 millimeters, a weight of approximately 850 grams, a range of accuracy of approximately 50 meters, and a magazine capacity of 15 cartridges.

According to the illustrated embodiment, system 10 comprises firing system 22 and transmitting system 18. Firing system 22 is operable to receive and fire one or more cartridges 46 in order to simulate the recoil associated with firing a gun and also to activate transmitting system 18. In the illustrated embodiment, firing system 22 includes a base 26, a chamber 94, a slide assembly 30, a trigger 34, a sear 38, and a hammer 42.

Base 26 may be configured to couple slide assembly 30, chamber 94, trigger 34, sear 38, and hammer 42, allowing each component to operate. Base 26 may be shaped to simulate the look and feel of any suitable gun, and may have any suitable dimensions, weight, and magazine capacity. In the illustrated embodiment, base 26 has a length of approximately 217 millimeters, a weight of approximately 850 grams, and a magazine capacity of 15 cartridges 46.

Chamber 94 may be coupled to base 26 and operable to receive cartridge 46. Chamber 94 may be further operable to hold cartridge 46 until hammer 42 strikes cartridge 46. In a further embodiment, chamber 94 may be further operable to dispose of cartridge 46 after cartridge 46 is fired.

Slide assembly 30 may be coupled to base 26. Slide assembly may be operable to move back and forth along base 26 to allow cartridge 46 to be loaded into chamber 94 and to position hammer 42 to strike cartridge 46. In the illustrated embodiment, slide assembly 30 may be manually operated in order to load cartridge 46 into chamber 94 and place hammer 42 in position. In this particular embodiment, the movement of slide assembly 30 in a direction 96 positions hammer 42 to strike cartridge 46. Additionally, the release of slide assembly 30 allows slide assembly 30 to move in a direction 97, back to its original position, to load cartridge 46 into chamber 94. In one embodiment, firing cartridge 46 may automatically load another cartridge 46 and position hammer 42 until cartridges 46 in the magazine have been fired.

Trigger 34 may be coupled to base 26 and may be operable to move sear 38 in direction 97. Sear 38 may be coupled to base 26 and may be operable to move in directions 96 and 97 and may be further operable to activate transmitting system 18. Moving in direction 96 allows sear 38 to hold hammer 42 in a position to strike cartridge 46. Moving in direction 97 causes sear 38 to release hammer 42. Hammer 42 may be coupled to base 26 and may be operable to strike cartridge 46. In the illustrated embodiment, when a user pulls trigger 34, sear 38 moves in direction 97 in sear slot 112, releasing hammer 42. As a result, hammer 42 strikes cartridge 46, firing cartridge 46.

Cartridge 46 may be operable to be fired, causing firing system 22 to simulate the recoil associated with firing a gun. In the illustrated embodiment, cartridge 46 comprises any suitable blank bullet operable to cause firing system 22 to simulate the recoil associated with firing a gun. In a further embodiment, cartridge 46 may be shaped to simulate the look and feel of any suitable bullet with any suitable caliber. For example, cartridge 46 may simulate a shotgun shell, a machine gun bullet, or a handgun bullet, and may further simulate a caliber between 4 and 12 millimeters. According to the illustrated embodiment, cartridge 46 simulates a handgun bullet with a caliber of 8 millimeters. In this particular embodiment, firing system 22 fires cartridge 46 in order to simulate the recoil associated with firing a handgun bullet from a handgun.

Transmitting system 18 is coupled to firing system 22 and operable to transmit simulation data in order to simulate the firing of any suitable bullet from any suitable gun. In the illustrated embodiment, transmitting system 18 includes a trigger board 14, an adaptor board 54, a controller board 50, and a laser tube 58.

Trigger board 14 may be operable to determine when hammer 42 is positioned to strike cartridge 46 and to determine when a user has pulled trigger 34. Trigger board 14 is discussed further in reference to FIGS. 3A and 3B. Adapter board 54 may be operable to determine when slide assembly 30 has been moved or when cartridge 46 has been fired by firing system 22. Adapter board 54 is discussed further in reference to FIGS. 2 and 4. Controller board 50 may be operable to cause simulation data to be transmitted from laser tube 58. Controller board 50 may be further operable to receive signals from adaptor board 54 and trigger board 14. Controller board 50 is discussed further in reference to FIGS. 2 and 4. Laser tube 58 may be operable to transmit simulation data in order to simulate the firing of any suitable bullet from any suitable gun. Laser tube 58 is discussed further in reference to FIG. 4.

Modifications, additions, or omissions may be made to system 10 without departing from the scope of the invention. The components of system 10 may be integrated or separated according to particular needs. Moreover, the operations of system 10 may be performed by more, fewer, or other components. For example, the operations of firing system 22 may be performed by other components.

Figure 2:
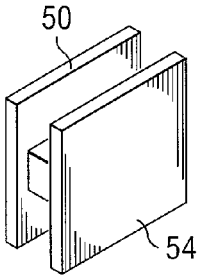
FIG. 2 is a cut-out drawing of one embodiment of the controller board and the adapter board of the system of FIG. 1.

FIG. 2 is a cut-out drawing illustrating one embodiment of controller board 50 and adapter board 54. Controller board 50 and adapter board 54 may be coupled to each other in any suitable manner. For example, controller board 50 and adapter board 54 may be connected by a wire or otherwise physically coupled to each other. In the illustrated embodiment, controller board 50 and adapter board 54 are physically coupled together, allowing controller board 50 to receive signals from adaptor board 54.

Figure 3A:
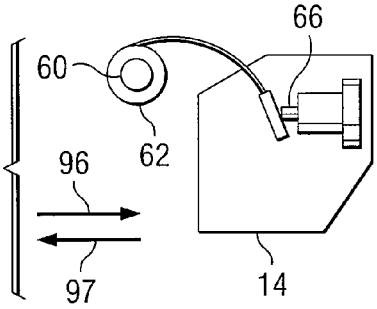
FIGS. 3A and 3B are side view diagrams of one embodiment of the trigger board of the system of FIG. 1.
Figure 3B:
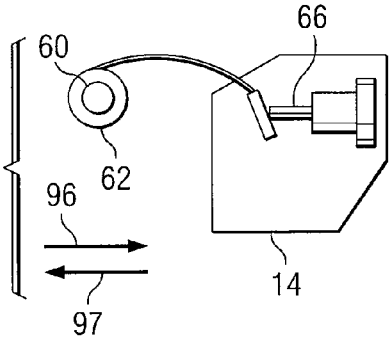

FIGS. 3A and 3B are side view diagrams of an embodiment of trigger board 14. Trigger board 14 determines when a user has pulled trigger 34 and sends signals to controller board 50, causing controller board 50 to instruct laser tube 58 to transmit simulation data. In the embodiment illustrated in FIG. 3A, trigger board 14 includes a sear screw 60, a screw connector 62, and a trigger sensor 66.

Sear screw 60 is an example of a sear protrusion that moves with sear 38. A sear protrusion may be formed from sear 38 or may be coupled to sear 38. Another example of a sear protrusion may be a pin coupled to sear 38. In the illustrated embodiment, the sear protrusion comprises sear screw 60. Screw connector 62 is an example of a sensor activator that is coupled to sear screw 60 and operable to activate trigger sensor 66. Examples of a sensor activator may include a spring or a flexible metal filament. In the illustrated embodiment, the sensor activator comprises screw connector 62 that includes a spring. According to the illustrated embodiment, a first portion of screw connector 62 is coupled to sear screw 60 and a second portion of screw connector 62 extends from sear screw 60 in order to activate trigger sensor 66. In one embodiment, the second portion of screw connector 62 is operable to be configured to activate the trigger sensor 66 of any suitable gun.

In the embodiment illustrated in FIG. 3A, sear 38 moves in direction 96, causing sear screw 60 and screw connector 62 to move in direction 96 and activate trigger sensor 66. In the embodiment illustrated in FIG. 3B, sear 38 moves in direction 97, causing sear screw 60 and screw connector 62 to move in direction 97 and deactivate trigger sensor 66.

Trigger sensor 66 may be operable to cause trigger board 14 to send a signal to controller board 50. In the illustrated embodiment, activation of trigger sensor 66 causes trigger board 14 to prepare a signal to send to controller board 50. When trigger sensor 66 is deactivated, trigger board 14 sends the signal to controller board 50. After receiving the signal, controller board 50 activates laser tube 58 to transmit simulation data. In the illustrated embodiment, the signal is sent to controller board 50 before hammer 42 strikes cartridge 46. Therefore, laser tube 58 transmits the simulation data before cartridge 46 is fired. In doing so, the recoil caused by firing cartridge 46 does not disrupt the transmittal of the simulation data, allowing for a more accurate transmittal of the simulation data.

In one embodiment, trigger board 14 may be coupled to controller board 50 in any suitable manner. For instance, trigger board 14 and controller board 50 may be connected by a wire or otherwise physically coupled to each other. In the illustrated embodiment, trigger board 14 is connected to controller board 50 by a wire. The wire allows trigger board 14 to be physically spaced from controller board 50. Therefore, trigger board 14 may be activated and deactivated by sear 38, but still capable of transmitting a signal to controller board 50.

Figure 4:
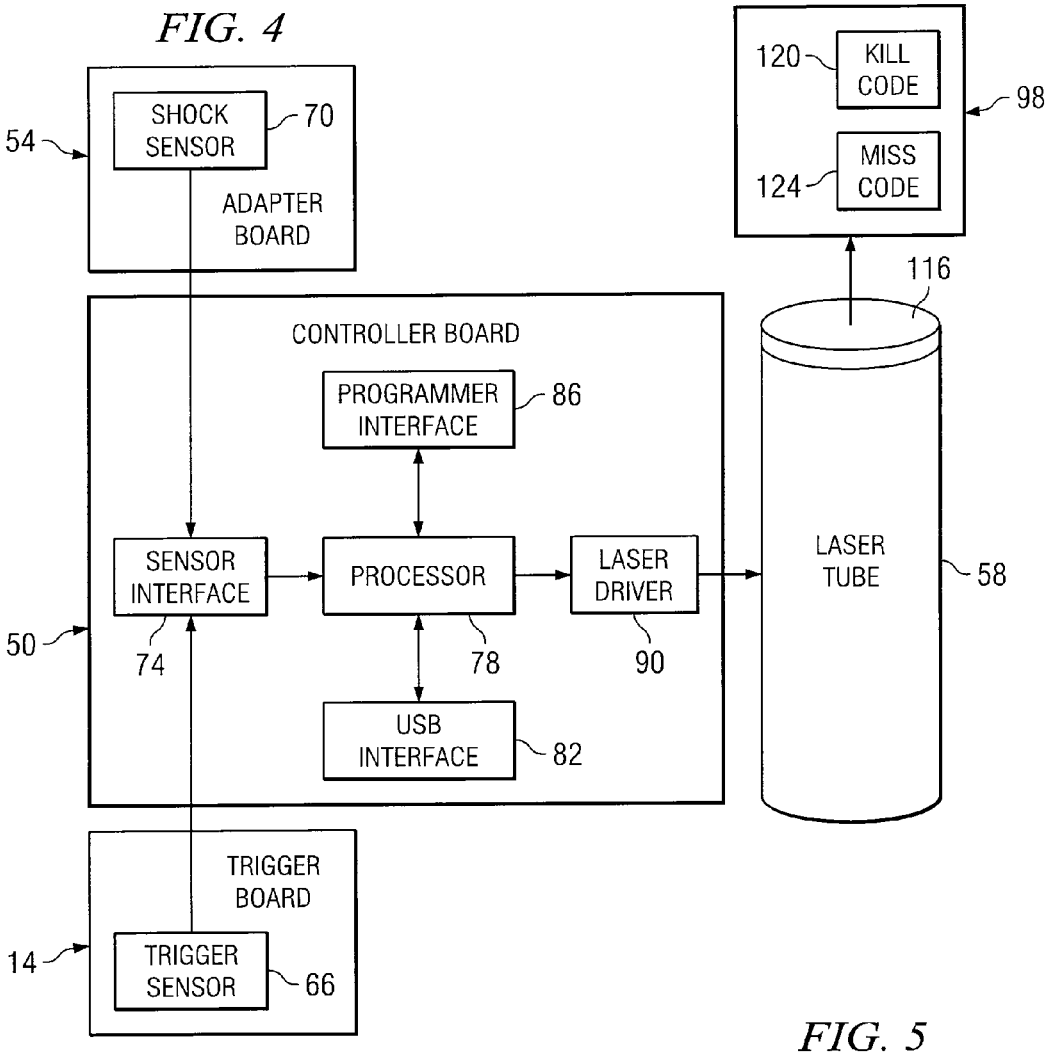
FIG. 4 is a block diagram of one embodiment of the transmitting system of the system of FIG. 1.

FIG. 4 is a block diagram of one embodiment of transmitting system 18. In the illustrated embodiment, transmitting system 18 includes adapter board 54, controller board 50, trigger board 14, laser tube 58, and simulation data 98.

Adapter board 54 may be operable to send a signal to reset controller board 50 after either slide assembly 30 is moved or cartridge 46 is fired. In the illustrated embodiment, adapter board 54 includes a shock sensor 70. Shock sensor 70 may be activated when it detects the movement of slide assembly 30 or the firing of cartridge 46. In one embodiment, shock sensor 70 may detect a vibration in base 26 caused by the movement of slide assembly 30 back to its original position. In a further embodiment, shock sensor 70 may detect the recoil caused by firing cartridge 46. Shock sensor 70 may instruct adaptor board 54 to send a reset signal to controller board 50.

In the illustrated embodiment, adaptor board 54 cannot send signals to controller board 50 unless shock sensor 70 is activated. This prevents the transmittal of simulation data 98 when there are no cartridges 46 in base 26. In a further embodiment, the activation of shock sensor 70 by the movement of slide assembly 30 allows simulation data 98 to be transmitted even if base 26 does not contain any cartridges 46. This allows transmitting system 18 to be tested without firing cartridge 46.

Controller board 50 may be operable to cause laser tube 58 to transmit simulation data 98 and may be further operable to receive signals from trigger board 14 and adapter board 54. In a further embodiment, controller board 50 may be operable to be programmed and re-programmed to vary the operations of controller board 50. In the illustrated embodiment, controller board 50 includes a sensor interface 74, a USB interface 82, a programmer interface 86, a processor 78, and a laser driver 90. Sensor interface 74 may be operable to receive signals from adapter board 54 and trigger board 14 and to send signals to processor 78. Sensor interface 74 may refer to any suitable device operable to receive signals from adaptor board 54 and trigger board 14.

USB interface 82 may refer to any suitable device capable of receiving input for controller board 50, sending output from controller board 50, performing suitable processing of the input or output or both, communicating to other devices, or any combination of the preceding. For example, USB interface 82 may include appropriate hardware (e.g., modem, network interface card, USB input, etc.) and software. In the illustrated embodiment, USB interface 82 allows a user to send data to controller board 50 to change the way controller board 50 operates. For example, a user may send data that changes the amount of simulation data 98 transmitted by laser tube 58. In a further embodiment, USB interface 82 may allow data to be retrieved from controller board 50, allowing a user to access any data corresponding to the use of system 10. For example, this may allow a user to view how many times simulation data 98 was transmitted from laser tube 58.

Programmer interface 86 may be operable to store data relevant to the use of transmitting system 18. In one embodiment, programmer interface 86 stores data controlling the way controller board 50 works. In the illustrated embodiment, the data stored by programmer interface 86 may be changed by a user using USB interface 82.

Processor 78 may refer to any suitable device capable of executing instructions and manipulating signals to perform operations for controller board 50. For example, processor 78 may include any type of central processing unit (CPU). In the illustrated embodiment, processor 78 includes a CPU capable of sending signals to laser driver 90, receiving signals from sensor interface 74, receiving data from USB interface 82 and programmer interface 86, and sending data to USB interface 82 and programmer interface 86.

Laser driver 90 may be operable to cause laser tube 58 to transmit simulation data 98. Laser driver 90 may refer to any suitable device operable to cause laser tube 58 to transmit simulation data 98. In one embodiment, laser driver 90 may be activated by signals from processor 78.

Laser tube 58 may be operable to transmit simulation data 98. In the illustrated embodiment, laser tube 58 transmits simulation data 98 upon being activated by laser driver 90. In the embodiment illustrated in FIG. 1, laser tube 58 is coupled to base 26, allowing it to be located underneath slide assembly 30. In a further embodiment, laser tube 58 may include a diffuser 116. Diffuser 116 may vary the amount and range of simulation data 98. In the illustrated embodiment, diffuser 116 causes laser tube 58 to transmit simulation data 98 to a range of approximately 50 meters.

Simulation data 98 may refer to any data operable to simulate the pathways associated with a bullet fired from a gun. In the illustrated embodiment, simulation data 98 refers to Multiple Integrated Laser Engagement System (MILES) code operable to be used in any MILES system. MILES code may include a KILL code 120 and a MISS code 124.

KILL code 120 may be operable, in one embodiment, to simulate the pathway of any suitable bullet fired from any suitable gun. KILL code 120 may be transmitted from laser tube 58 along the same path and with the same range as a bullet fired from a gun. In the illustrated embodiment, KILL code 120 simulates the pathway of a handgun bullet fired from a handgun. This allows a user to determine what the bullet would have hit if the bullet had actually been fired by the handgun. In a further embodiment, KILL code 120 may be transmitted from laser tube 58 before hammer 42 strikes cartridge 46. Therefore, the recoil caused by firing cartridge 46 does not disrupt the pathway simulated by KILL code 120.

MISS code 124 may be operable to simulate one or more pathways proximate to a pathway of a bullet fired from a gun. In the illustrated embodiment, MISS code 124 allows a user to determine the areas where a bullet would have nearly hit if fired from a handgun. In a further embodiment, MISS 124 code may be transmitted from laser tube 58 after cartridge 46 is fired.

Figure 5:
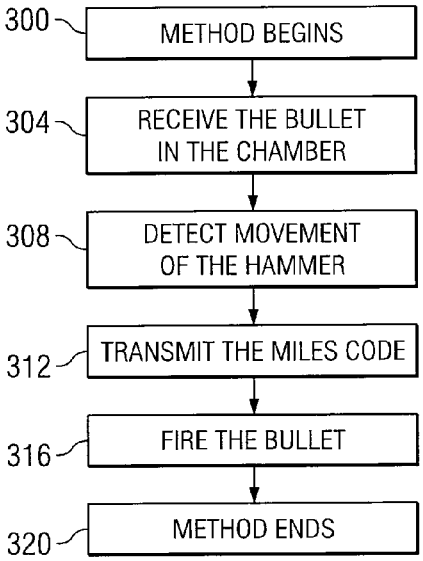
FIG. 5 is one embodiment of a method for simulating firing a gun.

FIG. 5 is one embodiment of a method for simulating firing a gun. The method may be performed by system 10 of FIG. 1. The method begins at step 300. At step 304, a cartridge is received in the chamber. In one embodiment, the cartridge is received in the chamber as a result of the slide assembly moving. This movement also positions the hammer to strike the cartridge and activates the trigger sensor. In another embodiment, the cartridge is automatically loaded into the chamber by firing the previous cartridge. In the illustrated embodiment, movement of the slide assembly or firing a cartridge activates the shock sensor.

Once the shock sensor is activated, the adaptor board sends a signal to the controller board, resetting the controller board and allowing the controller board to respond to a signal from the trigger sensor. If the controller board is not reset, the controller board may not respond to a signal from the trigger board.

At step 308, movement of the hammer is detected. Movement of the hammer is detected by the deactivation of the shock sensor when a user pulls the trigger. As a result, the trigger board sends a signal to the controller board, causing the controller board to activate the laser tube. MILES code, consisting of the KILL code, is transmitted at step 312 from the laser tube.

At step 316, the cartridge is fired. The cartridge is fired by the hammer striking the cartridge. This occurs, in one embodiment, after the KILL code has been transmitted by the laser tube. In a further embodiment, once the KILL code has been transmitted, the laser tube transmits the MISS code. At step 320, the method ends.

While this disclosure has been described in terms of certain embodiments and generally associated methods, alterations and permeations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A system configured to simulate firing a gun, the system comprising:

a firing system configured to fire a cartridge, the firing system comprising:

a chamber configured to receive and hold the cartridge; and a hammer configured to strike the cartridge;

a transmitting system configured to transmit simulation data prior to the hammer striking the cartridge, the transmitting system comprising a trigger sensor configured to:

detect movement of the hammer in a direction of striking the cartridge prior to the hammer striking the cartridge; and in response to detecting the movement, send a signal to initiate transmitting the simulation data prior to the hammer striking the cartridge, the simulation data simulating a pathway associated with a bullet fired from the gun and distinct from data describing the movement of the hammer; and a housing configured to simulate a look and feel of a handgun that fires a handgun bullet, the housing configured to house the firing system and the transmitting system.

2. The system of claim 1, wherein the transmitting system is further configured to transmit additional simulation data after the hammer has struck the cartridge.

3. The system of claim 2, wherein the additional simulation data comprises a Multiple Integrated Laser Engagement System (MILES) code including a miss code indicating one or more pathways proximate to the pathway of the bullet to a receiver.

4. The system of claim 2, wherein the transmitting system comprises a shock sensor configured to:

detect a recoil simulated by the firing system; and allow the simulation data to be transmitted.

5. The system of claim 1, wherein the simulation data comprises a Multiple Integrated Laser Engagement System (MILES) code including a kill code indicating the pathway of the bullet to a receiver.

6. The system of claim 1, wherein the cartridge comprises a blank bullet.

7. The system of claim 1, wherein the firing system is further configured to simulate a recoil associated with firing the gun.

8. The system of claim 1, wherein the transmitting system comprises:

a slide assembly configured to allow the chamber to receive the cartridge; and a shock sensor configured to:

detect movement of the slide assembly; and allow the simulation data to be transmitted.

9. The system of claim 1, wherein the transmitting system comprises a laser tube configured to transmit the simulation data.

10. The system of claim 1, wherein:

the transmitting system comprises a sear configured to move in a first direction to cause the hammer to move; and the trigger sensor is configured to detect movement of the sear in the first direction.

11. The system of claim 1, wherein the transmitting system comprises:

a trigger board configured to send the signal in response to detecting movement of a sear in a first direction; and a controller board configured to activate a laser tube in response to receiving the signal.

12. A method for simulating firing a gun, comprising:

receiving a cartridge in a chamber;

detecting, by a trigger sensor, movement of a hammer prior to the hammer striking cartridge;

in response to detecting the movement of the hammer in a direction of striking the cartridge, sending by the trigger sensor a signal to initiate transmitting simulation data using a transmitting system prior to the hammer striking the cartridge, the simulation data simulating a pathway associated with a bullet fired from the gun and distinct from data describing the movement of the hammer;

transmitting the simulation data using the transmitting system prior to the hammer striking the cartridge; and striking the cartridge with the hammer.

13. The method of claim 12, further comprising:

transmitting additional simulation data after the hammer has struck the cartridge.

14. The method of claim 12, wherein the simulation data comprises a Multiple Integrated Laser Engagement System (MILES) code including a kill code indicating the pathway of the bullet to a receiver.

15. The method of claim 13, wherein the additional simulation data comprises a Multiple Integrated Laser Engagement System (MILES) code including a miss code indicating one or more pathways proximate to the pathway of the bullet to a receiver.

16. The method of claim 12, wherein transmitting the simulation data prior to the hammer striking the cartridge further comprises:

moving a sear in a first direction to cause the hammer to move; and detecting movement of the sear in the first direction.

17. The method of claim 12, wherein transmitting the simulation data prior to the hammer striking the cartridge further comprises:

sending the signal in response to detecting movement of a sear in a first direction; and activating a laser tube in response to receiving the signal.

18. The method of claim 12, wherein:

the cartridge comprises a blank bullet; and the chamber, the trigger sensor, the hammer, and the transmitting system are housed within a housing configured to simulate a look and feel of the handgun.

19. A system for simulating firing a gun, the system comprising:

a means for receiving a cartridge;

a means for detecting movement of a hammer prior to the hammer striking the cartridge;

a means for, in response to detecting the movement of the hammer in a direction of striking the cartridge, sending a signal to initiate transmitting simulation data prior to the hammer striking the cartridge, the simulation data simulating a pathway associated with a bullet fired from the gun and distinct from data describing the movement of the hammer; and a means for transmitting the simulation data prior to the hammer striking the cartridge.

20. A system for simulating firing a gun, the system comprising:

a firing system configured to fire a cartridge and simulate a recoil associated with firing the cartridge, the cartridge comprising a blank bullet, the firing system comprising:

a chamber configured to receive and hold the cartridge and dispose of the cartridge after the cartridge is fired; and a hammer configured to strike the cartridge; and a transmitting system configured to:

detect movement of the hammer in a direction of striking the cartridge prior to the hammer striking the cartridge;

prior to the hammer striking the cartridge, initiate transmitting simulation data in response to detecting the movement of the hammer, the simulation data simulating a pathway associated with a bullet fired from the gun and distinct from data describing the movement of the hammer; and transmit additional simulation data after the hammer has struck the cartridge;

wherein the simulation data comprises a first Multiple Integrated Laser Engagement System (MILES) code, the first MILES code comprising a kill code indicating the pathway of the bullet to a receiver;

wherein the additional simulation data comprises a second MILES code the second MILES code comprising a miss code indicating one or more pathways proximate to the pathway of the bullet to the receiver; and wherein the transmitting system comprises:

a slide assembly configured to allow the chamber to receive the cartridge;

a shock sensor configured to detect movement of the slide assembly, detect the recoil simulated by the firing system, and allow the simulation data to be transmitted;

a sear configured to move in a first direction to cause the hammer to release;

a trigger board comprising a trigger sensor, the trigger sensor configured to send a signal in response to the trigger sensor detecting the movement of the sear in the first direction;

a controller board configured to activate a laser tube in response to receiving the signal, the laser tube configured to transmit the simulation data; and a housing configured to simulate a look and feel of a handgun that fires a handgun bullet, the housing configured to house the firing system and the transmitting system.

21. The system of claim 19, further comprising a housing configured to simulate a look and feel of the gun, the housing configured to house the means for receiving, the means for detecting, the means for sending, and the means for transmitting.

* * * * *